US005755127A

United States Patent [19]

Huang

[11] Patent Number: 5,755,127

[45] Date of Patent: May 26, 1998

[54] FAST ASSEMBLED TWIN EAR KEY RINGS

[76] Inventor: Yu-Hwei Huang, No.8, Lane 42, Sec. 2, Nan-Kan Road, Lou-Choo Hsiang, Taoyuan Hsien, Taiwan

[21] Appl. No.: 790,404

[22] Filed: Jan. 29, 1997

[51] Int. Cl.[6] ..... A44B 15/00

[52] U.S. Cl. ..... 70/456.07; 70/456.06

[58] Field of Search ..... 70/456 R–459; 24/3.6; D3/207–212

[56] References Cited

U.S. PATENT DOCUMENTS

| | | | |
|---|---|---|---|
| D. 373,899 | 9/1996 | Huang | D3/207 |
| 3,111,152 | 11/1963 | Goessling | D3/207 X |
| 3,968,670 | 7/1976 | Quenot | D3/207 X |
| 4,309,883 | 1/1982 | Brentini | 70/456 R |
| 4,376,383 | 3/1983 | Wolter | 70/456 R |
| 4,512,168 | 4/1985 | Reitze | 70/456 R |
| 4,584,858 | 4/1986 | Wolter | 70/456 R |
| 4,821,543 | 4/1989 | Scungio | 70/456 R |
| 5,031,430 | 7/1991 | Nelson | 70/456 R |
| 5,154,073 | 10/1992 | Huang | 70/456 R |
| 5,168,735 | 12/1992 | Wang | 70/456 R |
| 5,174,139 | 12/1992 | Huang | 70/456 R |
| 5,179,748 | 1/1993 | Lipic | 70/456 R X |
| 5,224,366 | 7/1993 | Huang | 70/456 R |
| 5,339,664 | 8/1994 | Mellor | 70/456 R |
| 5,495,734 | 3/1996 | Yu | 70/456 R |
| 5,501,089 | 3/1996 | Song | 70/456 R |

*Primary Examiner*—Suzanne Dino Barrett
*Attorney, Agent, or Firm*—Pro-Techtor International Services

[57] ABSTRACT

An easily assembled twin ear style key ring. The main body thereof is comprised of two casing halves, i.e., the front casing and the rear casing. A hollow stub on one of the casings extends through a hole provided on the other casing to quickly join the two casings together. The ends of the puller pins are inserted into positioning bushings having slightly larger diameters than the puller pins. The bushings are fixed in the main body by the front and the rear casings when the casings are pressed together. Manufacturing of the twin ear key rings is therefore faster than prior art devices, and is favorable to mass production.

3 Claims, 9 Drawing Sheets

FAST ASSEMBLED TWIN EAR KEY RINGS

BACKGROUND OF THE INVENTION

1. Field of the Invention

The present invention relates to easily assembled twin ear style key rings, and especially to those twin ear style rings capable of being manufactured more conveniently and faster than other key rings so that they are suitable for mass production.

2. Description of the Prior Art

Key rings have evolved from the traditional double metal ring structures to collecting disks. The collecting disk is generally provided with a small push button. Pressing and releasing the push button controls opening and closing of a peripheral engaging groove for adding or removing keys. However, the push button provided on the surface of the collecting disk can not be too large, therefore control is difficult. Further, only a single notch is normally provided on such a key ring, therefore, it is inconvenient to take off a specific key.

To improve on these shortcomings, the inventor created a key ring as disclosed in U.S. Pat. No. 29,042,596. This key ring is provided with an outlet for keys. The outlet is controlled by a pair of larger ears to render operation of they key ring easier and more convenient. Moreover, due to the ear controllers, the key collecting device can be designed to have various specific embodiments to be more acceptable to various users (such as children).

However, in the structure of the twin ear key ring described above, the ear portions allow puller pings to extend through some hollow rivet members. The rivet members are pressed tightly into the step-shaped through holes in the two ears. The ends of the puller pins must form a pressing combination structure with the hollow rivet members. If the main body of a key ring is formed by a combination of a front casing and a rear casing, rivets are required to affix them. Therefore, manufacturing of the whole key ring is more bothersome and time consuming.

SUMMARY OF THE INVENTION

The object of the present invention is to provide an easily assembled twin ear style key ring. The main body thereof is comprised of two casing halves, i.e., the front casing and the rear casing. A hollow stub on one of the casings extends through a hole provided on the other casing to quickly join the two casings together. The ends of the puller pins are inserted into positioning bushings having slightly larger diameters than the puller pins. The bushings are fixed in the main body by the front and the rear casings when the casings are pressed together. Manufacturing of the twin ear key rings is therefore faster than prior art devices, and is favorable to mass production.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
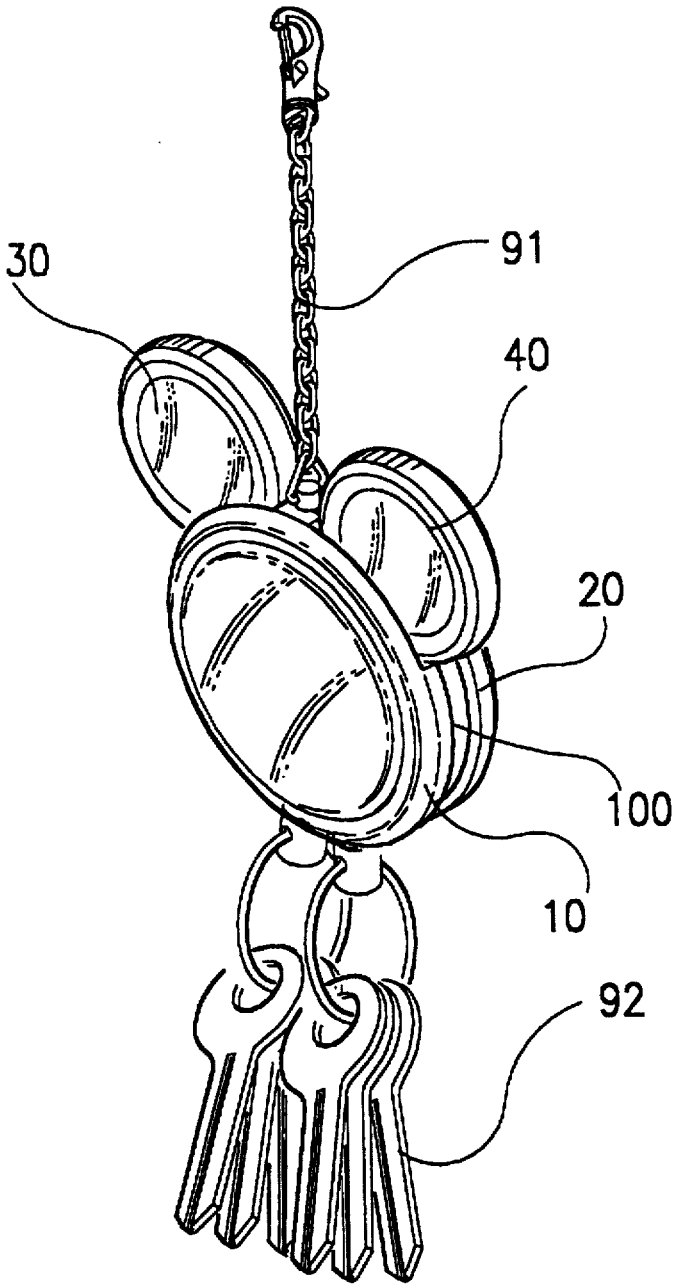
FIG. 1 is a perspective view of an embodiment of a key ring of the present invention with a chain connected thereto.

Referring first to FIG. 1, a key ring of the present invention is shown, comprising mainly a front casing 10 and a rear casing 20. The casings 10, 20 form a main body of the key ring. The main body has a peripheral groove 100 therein. Two controlling ear portions 30, 40 extend from the main body and are separated from each other. A chain 91 mat be provided between the two ears 30, 40. The groove 100 in the periphery of the main body is used to collect keys 92.

Figure 2:
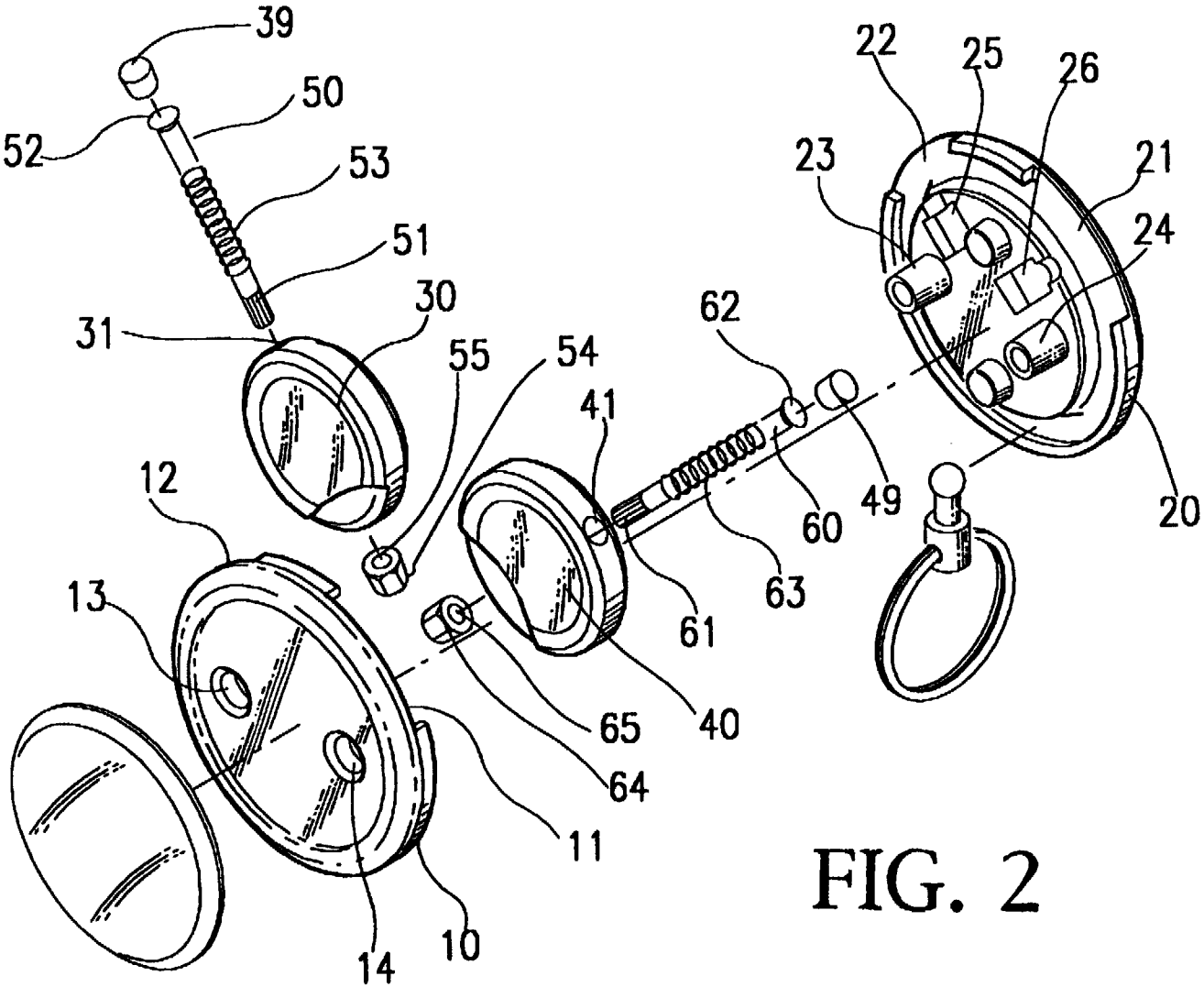
FIG. 2 is an exploded perspective view of the elements composing the present invention.
Figure 3:
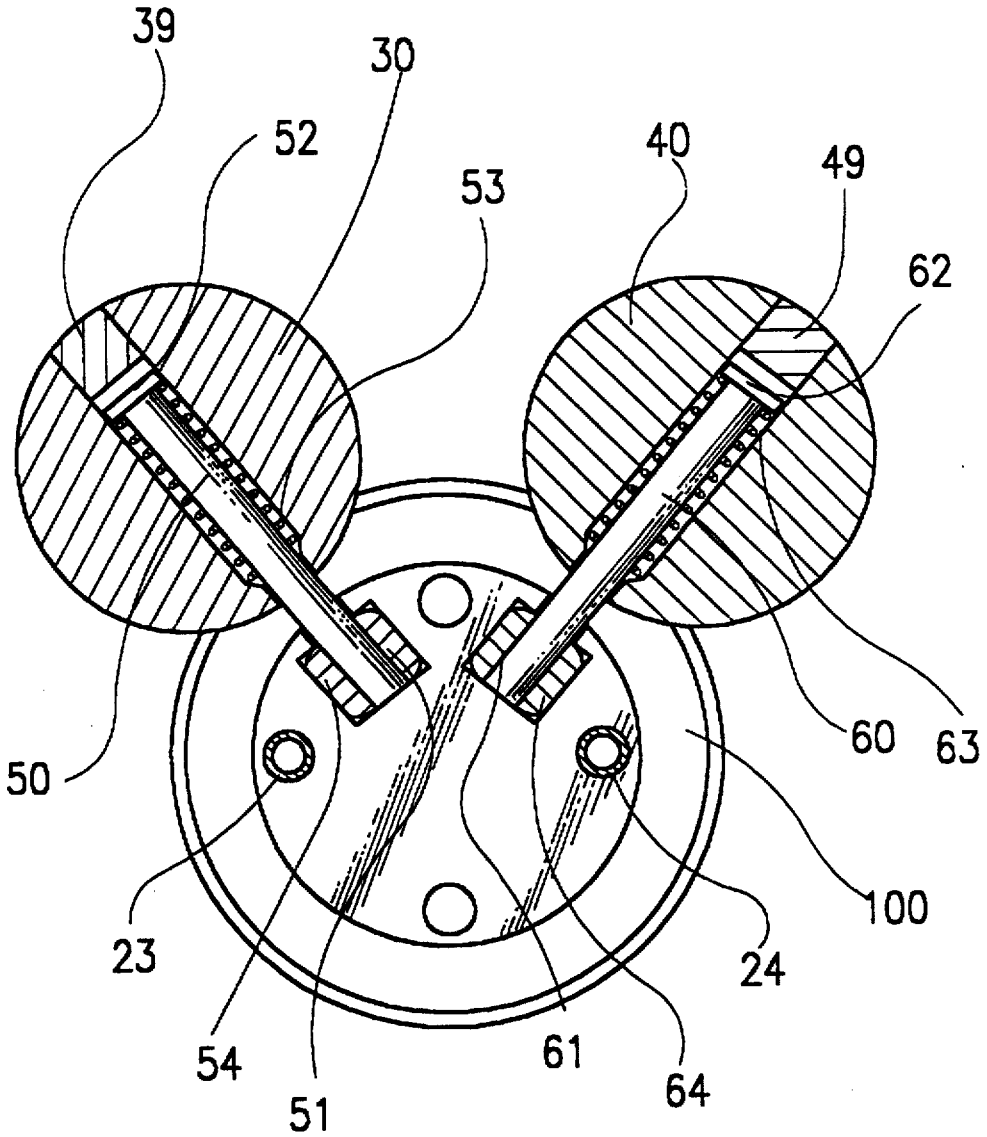
FIG. 3 is a transverse sectional view of an assembled embodiment of FIG. 2.
Figure 4:
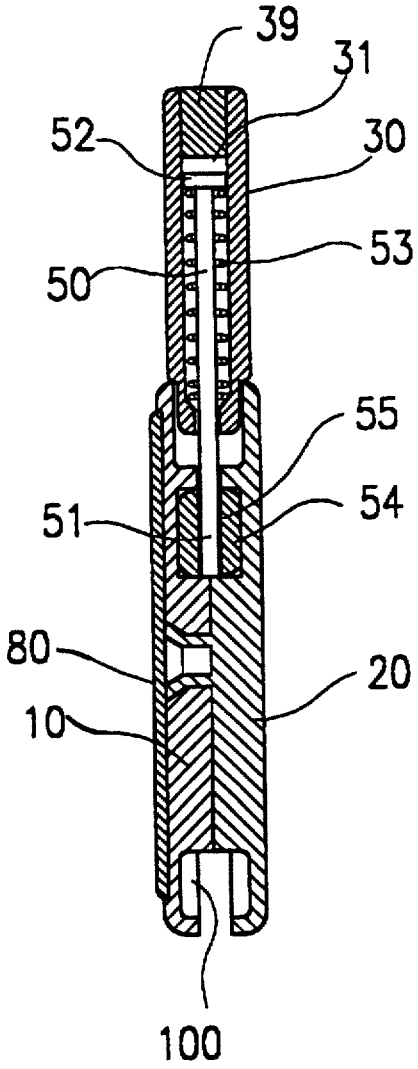
FIG. 4 is a longitudinal sectional view of an assembled embodiment of FIG. 2.

Referring now to FIGS. 2, 3, and 4, the above mentioned front and rear casings 10, 20 are provided on the upper sides thereof with opposing pairs of notches 11 & 12, and 21 & 22. When the casings 10, 20 are assembled, parts of the bottom edges of the two ears 30, 40 are received in the slots formed by the notches 11, 12, 21, 22. The rear casing 20 is provided on an inner surface thereof with two hollow stubs 23, 24. The front casing 10 is provided with two holes 13, 14 to receive the hollow stubs 23, 24. Further, the front and rear casings 10, 20 are provided with a plurality of T-shaped grooves 25, 26.

The ears 30, 40 are provided with radial step-shaped through holes 31, 41 that receive two puller pins 50, 60. The puller pins 50, 60 are provided on the bottom ends thereof with knurled ends 51, 61. The top ends of the puller pins 50, 60 are provided with rivet-like heads 52, 62. Two springs 53, 63 are provided for the shanks of the puller pins 50, 60. A set of polygonal bushings 54, 64 are provided with holes which are tightly connected to the knurled ends 51, 61 of the puller pins 50, 60.

Figure 5:
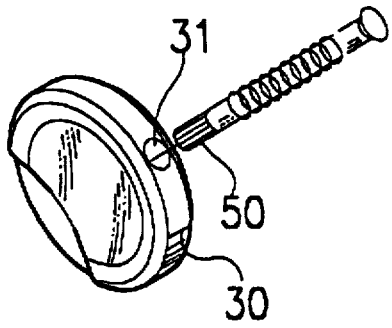
FIG. 5 is an exploded perspective view of an ear and a puller pin of the present invention.
Figure 6:
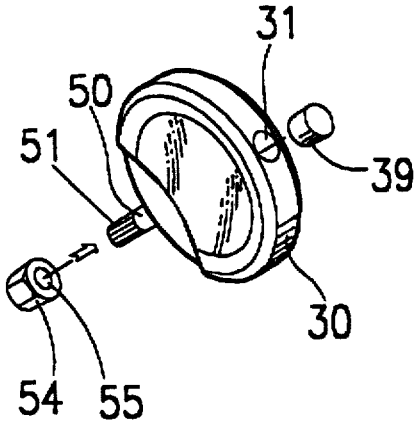
FIG. 6 shows the procedure of assembling the ear and puller pin of FIG. 5.
Figure 7:
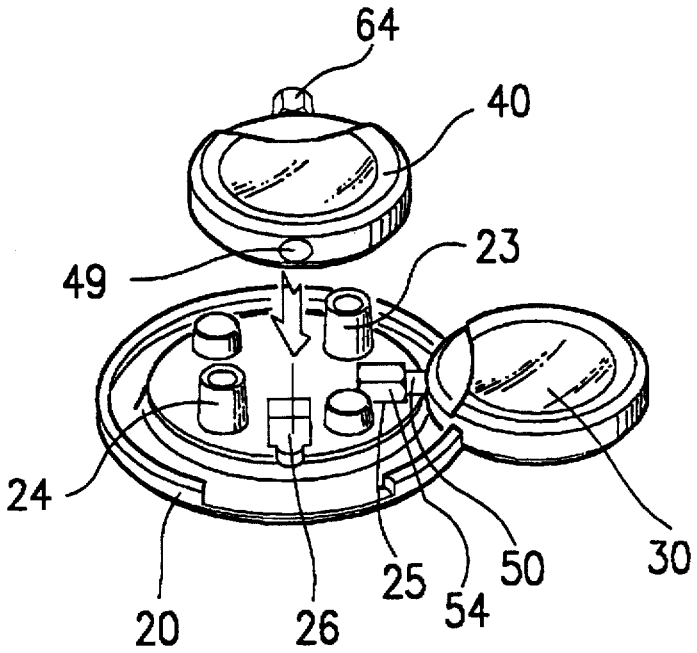
FIG. 7 is a schematic view showing the assembled member of FIG. 6 placed into a casing.

Taking ear 30 and its puller pin 50 as an example, and referring to FIGS. 5 and 6, the puller pin 50 is aligned with the step-shaped through hole 31 in the ear 30. One end of the spring 53 on the shank of the puller pin 50 is abutted against the rivet-like head 52. The other end of the spring 53 is abutted against the bottom end of the step-shaped through hole 31 (as shown in FIG. 3). The bottom end of the knurled end 51 extends through the ear 30 and is received tightly in the hole 55 provided in the polygonal bushing 54.

Figure 8:
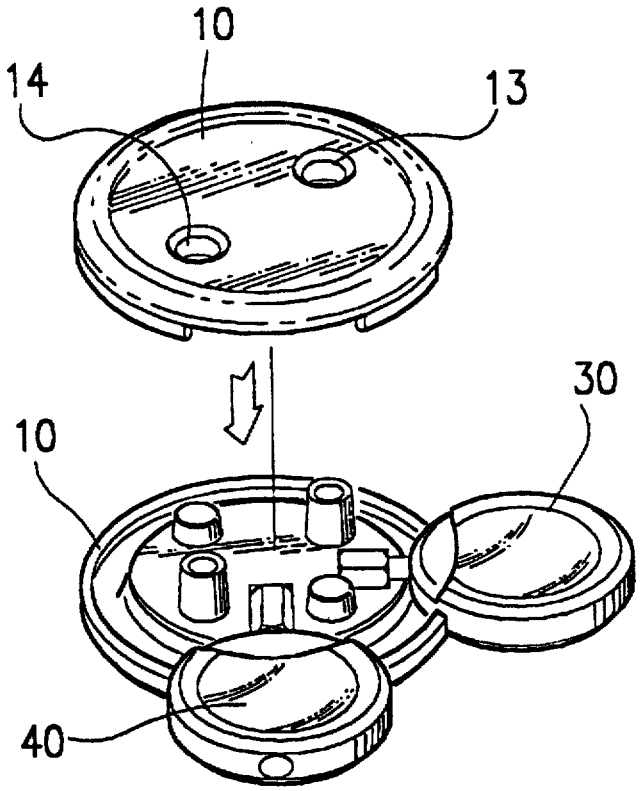
FIG. 8 shows the other casing positioned for assembly.
Figure 9:
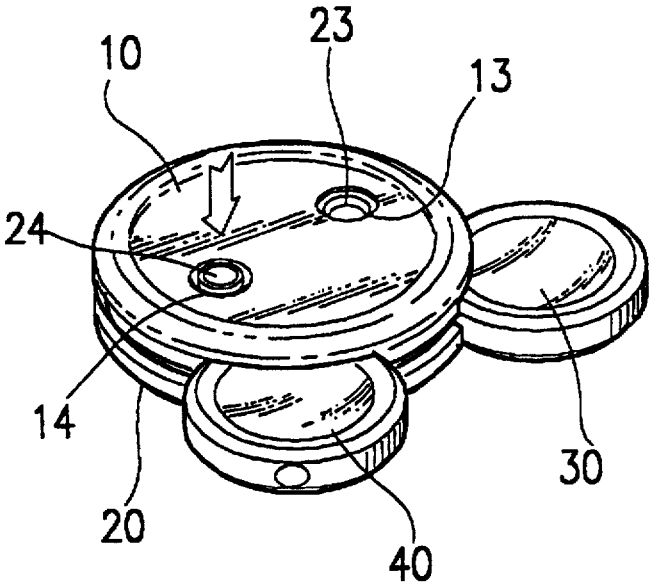
FIG. 9 is a view similar to FIG. 8 showing the next step of assembly, wherein the front and the rear casings are assembled.
Figure 10:
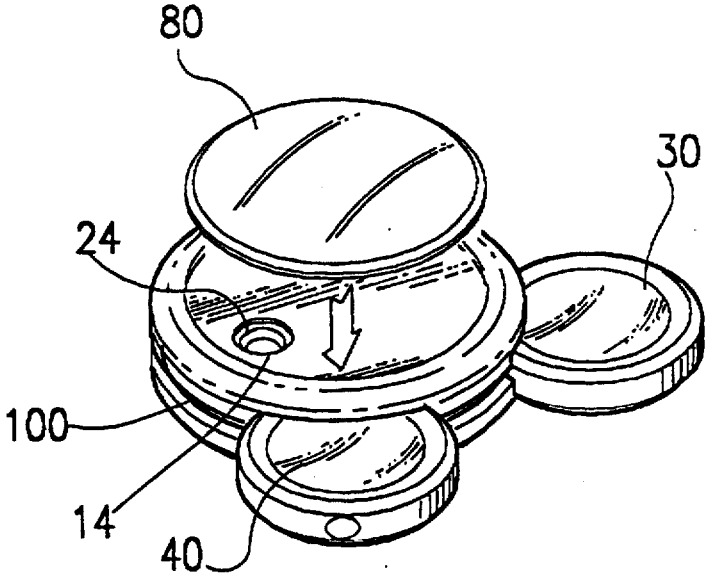
FIG. 10 shows a decorative article being added to the device of FIG. 9.

The puller pins 50, 60, assembled in the ears 30, 40, are placed in the T-shaped grooves 25, 26 of the rear casing 20 so that the bushings 54, 64 are received in the T-shaped grooves 25, 26. The front casing 10 is placed, as shown in FIG. 8, on the two hollow stubs 23, 24 which extend out of the two holes 13, 14 on the front casing 10. Then, as is shown in FIG. 9, the hollow stubs 23, 24 are rivetted to form the main body of the key ring. A decorative panel 80 is adhered to the surface of the front casing 10 as shown in FIG. 10. Two filling chocks 39, 49 are then placed into the step-shaped through holes 31, 41 (FIG. 3) to complete the key ring.

In the process of assembling the present invention, the ears and the puller pins are tightly press connected with each other on the ends of the puller pins. The hollow stubs 23, 24 extend through the front casing 10 so that they serve as rivets when the front and rear casings are joined to complete assembly of the main body of the key ring. This assembly is very fast and convenient, and therefore the present invention is suitable for mass production.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

Having thus described the technical structure of my invention, what I claim as new and desire to be secured by letters patent of the United States is:

1. A twin ear style key ring comprising:

a front casing and a rear casing that form a main body of said key ring, said main body has a peripheral groove with two controlling ear portions extending from an upper side of said main body, wherein:

said rear casing includes two hollow stubs, said front casing includes two holes to receive said hollow stubs, said front casing and said rear casing each include two T-shaped grooves;

said ears each include radial step-shaped through holes to receive two puller pins, a bottom end of each said puller pin is knurled, springs are provided on the shanks of said puller pins, said knurled ends of said puller pins are received in bushings that are in turn received in T-shaped grooves in said casing; and said hollow stubs serve as rivets to secure said front casing to said rear casing.

2. The twin ear style key ring of claim 1 wherein:

a first end of said springs on said shanks of said puller pins abuts rivet heads of said puller pins, a second end of said springs abuts bottom ends of said step-shaped through holes.

3. The twin ear style key ring of claim 1 wherein:

said bushings are polygonal, and include holes to receive said knurled ends of said puller pins.

* * * * *